US006421877B1

(12) United States Patent
Mih

(10) Patent No.: US 6,421,877 B1
(45) Date of Patent: Jul. 23, 2002

(54) FITTING FOR THE PIVOTING SUPPORT OF A WINDOW SASH OR DOOR LEAF

(75) Inventor: Phillippe Mih, Sarrebourg (FR)

(73) Assignee: Ferco International Ferrures et Serrures de Batiment, Reding (FR)

( * ) Notice: Subject to any disclaimer, the term of this patent is extended or adjusted under 35 U.S.C. 154(b) by 0 days.

(21) Appl. No.: 09/528,619

(22) Filed: Mar. 20, 2000

Related U.S. Application Data

(63) Continuation of application No. PCT/EP98/05897, filed on Sep. 16, 1998.

(30) Foreign Application Priority Data

Sep. 25, 1997 (DE) ..... 297 17 177 U

(51) Int. Cl.[7] ..... E05D 7/04
(52) U.S. Cl. ..... 16/238; 49/192
(58) Field of Search ..... 16/238, 237, 239, 16/240, 105, 235; 49/192

(56) References Cited

U.S. PATENT DOCUMENTS 3,368,306 A * 2/1968 Von Wedel et al. ..... 49/192
3,994,093 A * 11/1976 Mayer et al. ..... 49/192
4,208,838 A * 6/1980 Kleine et al. ..... 49/192
4,739,583 A * 4/1988 Tonsmann et al. ..... 49/192

FOREIGN PATENT DOCUMENTS

| | | | |
|---|---|---|---|
| DE | 297 07 358 U1 * | 10/1998 | ..... E05D/15/52 |
| EP | DE-0674075 A1 * | 9/1995 | ..... E05D/7/12 |
| FR | 2275626 * | 1/1976 | ..... E06B/3/50 |
| WO | WO-9848136 * | 10/1998 | ..... E05D/15/52 |

* cited by examiner

*Primary Examiner*—Lynne H. Browne
*Assistant Examiner*—Doug Hutton
(74) *Attorney, Agent, or Firm*—Alix, Yale & Ristas, LLP

(57) ABSTRACT

In order to support a window sash on a fixed frame in such a way that it can pivot around a vertical axis, a horizontal support arm is provided which is connected with a frame-side pivot bearing by means of a support angle, the vertical leg of which grips behind a support plate. An adjusting device which acts in the horizontal direction to change the distance between the sash and the axis of the pivot bearing is not placed in the region of the support angle, but rather at the end of the support arm which is away from the pivot bearing, and acts between the support arm and a filler piece which is fastened in the groove channel of the sash.

4 Claims, 2 Drawing Sheets

FIG.2
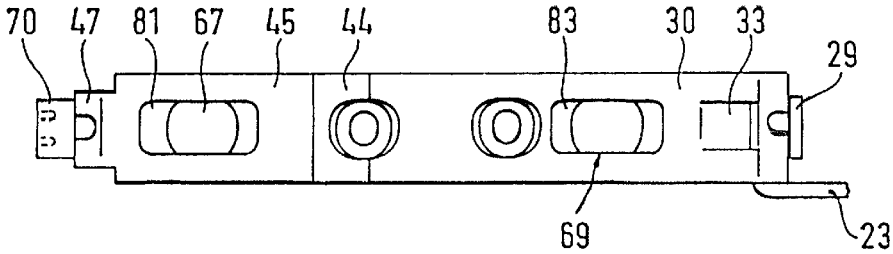
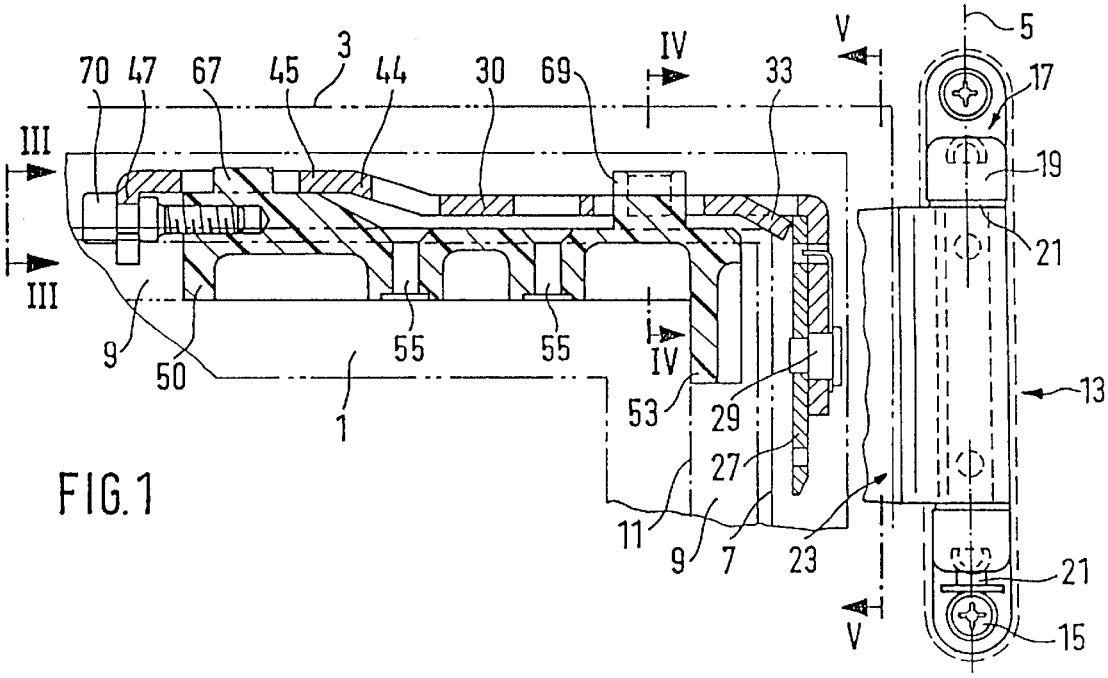
FIG.1
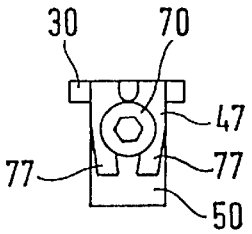
FIG.3
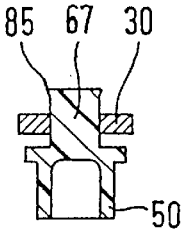
FIG.4
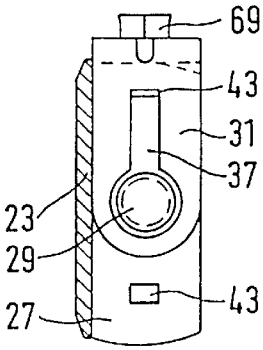
FIG.5

FITTING FOR THE PIVOTING SUPPORT OF A WINDOW SASH OR DOOR LEAF

CROSS-REFERENCE TO RELATED APPLICATION

This is a continuation of International Application No. PCT/EP98/05897 filed Sep. 16, 1998.

BACKGROUND OF THE INVENTION

This invention pertains to a fitting for the pivoting support of a window sash or door leaf which is provided with a groove-area channel.

As a rule, modern windows are equipped with a pivot-tilt sash which is supported on the frame in such a way that it can pivoted around a vertical axis and tilted around a horizontal axis as desired. The fitting for the pivot-tilt support of such a sash is comprised of a corner support in the lower corner and a scissor-like opening-out arm at the upper corner. Along with pivot-tilt sashes, there are also pivot sashes which are supported on the frame pivoting only around a vertical axis. Traditionally, the fitting for the pivoting support of a sash is designed in completely different way than a pivot-tilt fitting, and usually consists of two strap hinges, or even three in the case of very high windows. This means that fittings for pivot-tilt sashes and for pivot sashes have different appearances and are made up of fitting components, each of which has to be produced differently and maintained in stock.

In the course of the modernization and standardization of window fittings, it is desirable to make the design of pivot-tilt fittings and pivot fittings as similar as possible. First, such fittings should have as uniform an appearance as possible, so that in the case of a double-sash window with one pivot-tilt sash and one pivot sash, for example, the fitting components visible on the window have as uniform and symmetrical appearance as possible. Second, it is desirable to design as many components of the fitting as possible in such a way that they can be used both for the pivot-tilt fitting as well as for the pivot fitting. In this way, only a few fitting components have to be switched, and thus produced and maintained in inventory separately, when choosing between a pivot-tilt fitting and a pivot fitting. In addition, pivot-tilt fittings are normally provided with an adjusting device for adjusting the position of the sash relative to the frame in the vertical direction. This adjustment takes place at the lower corner support, while the upper opening-out scissors can follow this adjustment as a result of the play which is present in the link pins which connect it with the sash. In the case of pivot sashes supported by strap hinges, such horizontal adjustability is traditionally not present.

FR-A-2 275 626 discloses a pivot-tilt fitting, the opening-out arm of which is connected with the sash in a pivoting fashion and can be fixed for the pivoting operation and loosened from the sash for the tilting operation by means of a closing piece which can be actuated via a connecting rod. An adjusting device acts between a filler piece which can be fixed in the groove channel of the sash and a support rail which is used for the support of the opening-out arm.

EP-A-0 674 075 discloses a pivot fitting, the support arm of which is supported in pivoting fashion on the pivot bearing and can be fastened by means of a snap connection to a filler piece fastened in the groove channel of the sash. An adjusting device acts between the filler piece and a support angle for the end of the support arm, which support angle is guided in sliding fashion on the filler piece.

In the German Registered Utility Model application 297 07 358.3, which was not published in advance, a fitting for pivot sashes is described in which the pivot sash is supported in the manner of a pivot-tilt sash with one lower corner support and one upper support arm, whereby the support arm, unlike the opening-out arm of a pivot-tilt sash, is connected with the sash in non-pivoting fashion with reference to the vertical axis of rotation. The support arm is designed to be elastically flexible enough in the vertical direction that it can follow vertical adjustment movements made at the lower corner support. FIGS. 15 through 18 of this Registered Utility Model disclose a form of implementation which has inserted into the groove-area channel of the sash a filler piece to which the support arm is attached in such a way that it remains movable in a restricted fashion relative to the filler piece in the vertical direction, but is supported and guided in positive fashion with respect to horizontal forces acting on the filler piece perpendicular to the plane of the sash.

The invention is directed towards a structural simplification of such a fitting, while still maintaining all of its functional features. The simplification pertains to the following problem:

In accordance with the standard model of the conventional pivot-tilt fittings with an opening-out arm, the pivot fittings with support arm described in the Registered Utility Model application mentioned above have in the region of the support arm an adjusting device which acts in the horizontal direction and which is used to adjust, within a range of adjustment, the distance between the sash and the vertical axis of the pivot bearing. In accordance with the standard model of numerous corresponding adjusting devices for the opening-out arms of pivot-tilt fittings, this adjusting device is designed in such a way that the support arm is guided in a sliding fashion in the horizontal direction on the horizontal leg of the support angle connecting it with the support plate, and that an adjusting screw is active between the vertical leg of the support angle and the support arm. The adjusting device is thus provided at the support arm end facing the pivot bearing, and acts between same and the support angle in a region where relatively little space is available for the accommodation of an adjusting device of this type.

SUMMARY OF THE INVENTION

According to the invention, the support arm is designed in one piece with the support angle, i.e., the vertical leg of the support angle consists simply of an appropriate bending of the support arm itself. The adjusting device for the horizontal adjustment has been shifted to a support arm location at a distance from the pivot bearing, specifically, at its other end, and acts between same and the filler piece. As a result, more favorable space relationships are provided for the designer and greater freedom of form for the design of the adjusting device.

BRIEF DESCRIPTION OF THE DRAWINGS

One form of implementation of the invention is explained in more detail with the aid of the drawings. The following are shown:

FIG. 1 illustrates the fitting in the assembled state, shown in side view;

FIG. 2 illustrates a top view of the fitting according to FIG. 1;

FIG. 3 illustrates a front view per the arrows III—III from what is the left end in FIG. 1;

FIG. 4 illustrates a section per the line IV—IV in FIG. 1;

FIG. 5 illustrates a partially sectioned view from the right end per the arrows V—V in FIG. 1;

DETAILED DESCRIPTION OF THE PREFERRED EMBODIMENT

Figure 6:
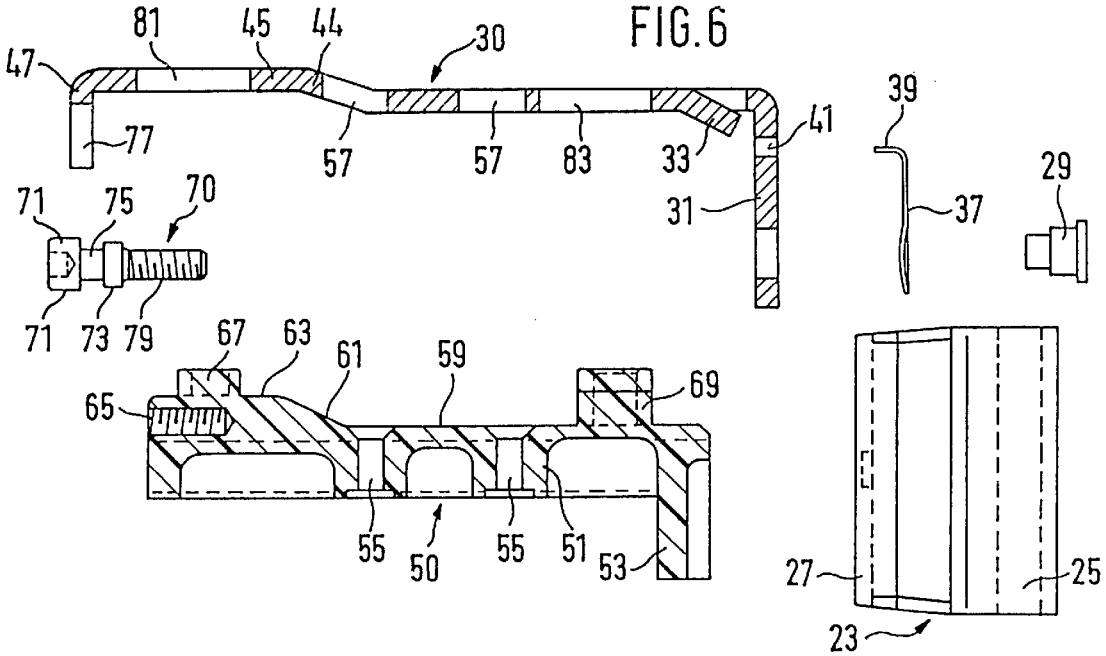
FIG. 6 illustrates an assembly of the individual components of the fitting in a side view corresponding to FIG. 1.

The fitting shown in FIG. 1 is used for supporting, in the region of its upper corner and in pivoting fashion around a vertical axis 5, a casement 1, indicated by dotted lines, on a frame 3. At both the horizontal and vertical capping pieces, the casement 1 has a groove area 7, into which a conventional groove channel 9 whose bottom area is indicated at 11 has been incorporated, and which can be used in the known manner for the holding of driving rods and other components of an edge mechanism. To support the casement 1 on the frame 3, a pivot bearing 13 is used which possesses a fixed support piece 17 which has support eyes 19 and which can be fastened in fixed fashion to the frame 3 by means of screws 15 and on which a movable support piece 23 is supported in pivoting fashion around the axis 5 by means of an axle pin 21 seated in the support eyes 19.

Figure 7:
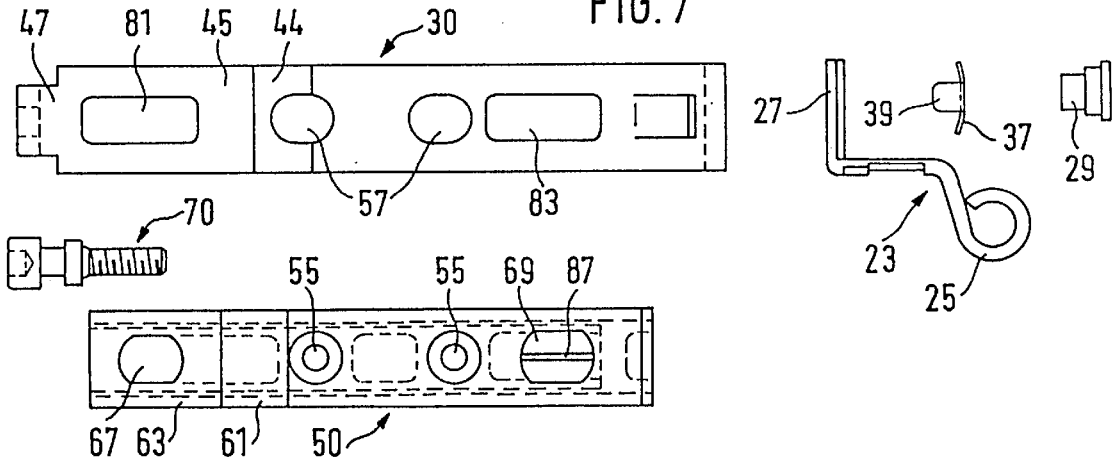
FIG. 7 illustrates the individual components of the fitting in a top view corresponding to FIG. 2.

As can be seen especially well in FIG. 7, the movable support piece 23 is bent from a single piece of sheet metal and has a support sleeve 25 which surrounds the support pin 21, and at the other end, a support plate 27 which is bent at a right angle and which in the installed state runs parallel to the vertical groove area 7 of the casement and engages in the groove space between the latter and the corresponding groove area of the frame.

The fastening of the casement 1 at the pivot bearing 13 is carried out by means of a support arm 30 which is bent from flat steel and a filler piece 50 which is preferably made of plastic produced by injection molding. The support arm 30 and filler piece 50 are shown in side view in FIG. 6 and in top view in FIG. 7.

Figure 8:
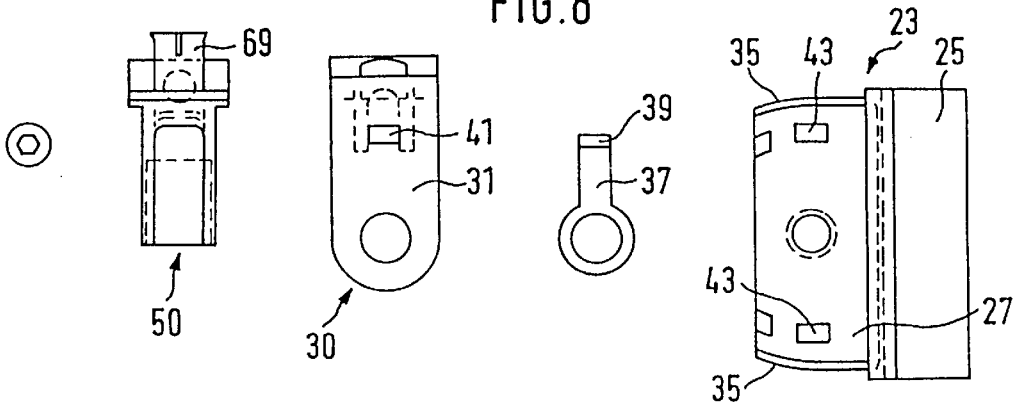
FIG. 8 illustrates the individual components of the fitting in views corresponding to FIGS. 3, 4 and 5.

At its end facing the pivot bearing 13, the support arm 30 is bent downward at a right angle to form a vertical leg 31 which, with the support arm 30, forms a one-piece support angle and grips under the support plate 27 of the pivot bearing. The vertical leg 31 lies on the side of the support plate 27 facing the pivot bearing 13, and is supported on the support plate 27 in a captive fashion and pivoting around a horizontal axis by means of a rivet 29 which passes through corresponding holes in the leg 31 and the support plate 27. This pivoting support of the support arm 30 on the support plate 27 is used to change the fitting over to right or left latching. A mortised tongue 33 of the support arm 30 lies with its end against the surface of the support plate 27 which faces away from the pivot bearing 13, so that the upper edge of the support plate 27 is held between the tongue 33 and the vertical leg 31 of the support arm 30. As can be seen especially well in FIG. 8 on 35, the upper and lower edges of the support plate 27 are rounded in order to make it easier for the tongue 33 to ascend during the pivoting of the support arm 30 relative to the support plate 27.

In order to lock the support arm 30 relative to the support plate 27 in the given pivoting position corresponding to right or left latching, also supported by means of the rivet 29 is a leaf spring 37 which lies against the back side of the vertical leg 31 of the support arm 30, and the end 39 of which is bent at a right angle and engages as a lock pin in the aligned openings 41, 43 in the support arm 30 and the support plate 27. The spring 37 can be bent against its spring force away from the vertical leg 31 of the support arm 30 in order to withdraw the lock pin 39 from the opening 43 in the support plate 27 and thus release the support arm 30 to pivot relative to the support plate 27.

The horizontal leg of the support arm 30 lies outside the groove channel of the casement 1 on its upper groove area 7 and has approximately at its longitudinal midpoint a downward bend 44 so that the end section 45 of the support arm 30 is moved away from the groove area of the casement 1. At its end away from the pivot bearing 13, the support arm 30 has a leg 47 which is bent downward at a right angle and which is additionally decreased in its width so that it can engage in the upper groove channel 9 of the casement 1.

The support arm 30 is not connected with the casement 1 directly, but rather via the filler piece 50. The filler piece 50 is preferably an injection molded piece made of plastic, and has a horizontal part 51 which is inserted into the upper groove channel of the casement and in essence completely fills the latter, and a vertical leg 53 which engages in the vertical groove channel 9 of the casement. The filler piece 50 is fastened to the casement with screws (not shown) which are inserted into corresponding locating holes 55 of the filler piece 50 and are screwed into the bottom of the groove channel 9 of the casement. The support arm 30 has through holes 57 which are assigned to the locating holes 55 for the insertion of the screws and the tool for the screws.

The upper side 59 of the filler piece 50 (FIG. 6) preferably runs even with the groove surface of the casement, and in the direction towards the end away from the pivot bearing 13 it makes a transition via an angled area 61 into a raised support surface 63 on which the end region 45 of the support arm 30 can lie.

At its end away from the pivot bearing 13, the support arm 30 is connected with the filler piece 50 by means of a horizontal connecting and adjusting screw 70. The latter possesses, between the screw head 71 and a collar 73, a reduced area 75 which is held in the vertically bent end section 47 in a slot between two arms 77. As can be seen in FIG. 3, the two arms 77 are curved towards each other so that the slot which is formed in between them is narrowed at its end. As a result, the screw 70 is captively secured on the support arm 30 and is supported on it in such a way that it can pivot but cannot move axially. The threaded section 79 of the screw 70 engages in a threaded hole made in the filler piece 50; however, the screw 70 can be a self-tapping screw so that the bore 65 can be drilled as a smooth bore and the screw 70 will cut the associated inside thread when screwed into the bore 75. By means of this screw 70, the end of the support arm 30 which is at a distance from the pivot bearing 13 is fastened to the filler piece 50 in such a way that it can be adjusted in its longitudinal direction, i.e., in the horizontal direction and parallel to the plane of the sash.

Formed onto the raised area 63 of the filler piece 50, on which section 45 of the support arm 30 rests, is a centering projection 67 which engages in a window 81 cut in the support arm 30, and specifically, with essentially no play in the direction perpendicular to the plane of the sash and with sufficient play in the longitudinal direction of the support arm 30 for the adjustment by means of the screw 70. In addition, formed on the upper side 59 of the filler piece 50 near its vertical leg 53 is a guide projection 69 which protrudes upward and which engages in a guide slot 83 of the support arm 30. As can be seen from FIGS. 4 and 7, this guide projection can exhibit at its upper edge sideways projecting edges 85 and a slot 87 cut in its center so that it can be springably inserted with a snap action into the guide slot 83 of the support arm 30.

As can be seen from FIG. 1, the horizontal part of the support arm 30 placed to the right of the downward bend 44 runs at a distance from the filler piece 50, and, because of the flexibility present in the support arm, especially in the region of the downward bend 44, this region can be moved in a limited fashion vertically relative to the filler piece 50, but is supported in a positive fashion by the guide and centering projections 69, 67 with respect to the forces acting together perpendicular to the plane of the sash (plane of projection in FIG. 1).

As a result of this, a fitting which is configured simply in terms of design is created, which makes possible a secure supporting of the casement 1 on the pivot bearing 13 with enough load-carrying capability with respect to all forces acting at a right angle to the pivot axis 5. In the direction parallel to the pivot axis 5, limited movability exists between the support arm 30 and the filler piece 50 fastened to the casement 1, so that the fitting can accommodate vertical adjusting movements of the sash 1 which are carried out at the corner support (not shown) which is provided at the lower corner of the casement and which hold the weight of the sash. In addition, the possibility of adjustment in the horizontal direction parallel to the plane of the sash exists between the support arm 30 and the filler piece 50 by means of the adjusting screw 70, in order to be able to change the distance between the casement 1 and the pivot axis 5 of the pivot bearing 13. The adjusting screw 70 is placed at a location on the support arm 30 which is at a distance from the pivot bearing 13, specifically, at the end of the support arm 30 which is away from the pivot bearing, as a result of which more space is available for the adjusting device, and better access to the adjusting screw 70 by a tool for the screw is also provided, than would be the case if it were at the end of the support arm 30 which faces the pivot bearing 13.

The pivot bearing 13 can also be used, unchanged, for a pivot-tilt fitting. In this case, instead of the vertical leg 35 of the support arm 30, the vertical leg of a short holding angle is supported in pivoting fashion on the support plate 27 by means of the rivet 29, and this holding angle, preferably adjustably fastened in the horizontal direction, is the conventional opening-out arm of a pivot-tilt fitting.

What is claimed is:

1. A fitting for the pivoting support on a frame of an associated member such as a window sash or door leaf that defines a plane, the associated member having at least one vertical groove area and at least an upper corner, which comprises:

a pivot bearing which has a vertical axis of rotation and attaching structure for attachment to the associated frame, and a movable support piece including a support plate which is bent at a right angle to the plane of the associated member and which is dimensioned and configured for the engagement between the at least one vertical groove area, an essentially horizontal support arm which is connected with the support plate by means of a support angle, the vertical leg of which grips behind the support plate, a filler piece dimensioned and configured for insertion into the groove channel of at least the upper horizontal groove area, the filler piece being fastened in the groove channel, a connection between the support arm and the filler piece guiding the support arm with limited movability in the vertical direction, the support arm being supported against forces acting perpendicular to the plane of the member, and an adjusting device which acts upon the support arm and in the horizontal direction to change the distance between the member and the axis of the pivot bearing, wherein the support angle is formed onto the support arm as one piece, and the adjusting device is placed at a location on the support arm which is at a distance from the pivot bearing, and acts between the support arm and the filler piece.

2. A fitting according to claim 1, characterized in that the adjusting device comprises an adjusting screw which is supported on the end of the support arm away from the pivot bearing in such a way that it can pivot but cannot move axially, and which engages in a threaded bore in the filler piece.

3. A fitting according to claim 1, characterized in that the filler piece comprises on its upper side one or more projections which protrude upward, and each projection engages in a section provided on the support arm in such a way that the support arm is movably guided on the filler piece in the vertical direction and in its longitudinal direction, and is supported in positive fashion against forces acting perpendicular to the plane of the member.

4. A fitting according to claim 2, characterized in that the filler piece comprises on its upper side one or more projections which protrude upward, and each projection engages in a section provided on the support arm in such a way that the support arm is movably guided on the filler piece in the vertical direction and in its longitudinal direction, and is supported in positive fashion against forces acting perpendicular to the plane of the member.

* * * * *